US009670716B2

(12) United States Patent
Deiss et al.

(10) Patent No.: US 9,670,716 B2
(45) Date of Patent: Jun. 6, 2017

(54) SEALING ELEMENT FOR SEALING JOINTS IN THE AREA OF WINDOWS

(71) Applicant: ISO-Chemie GmbH, Aalen (DE)

(72) Inventors: Martin Deiss, Abtsgmuend (DE); Andreas Lange, Urbach (DE)

(73) Assignee: ISO-Chemie GmbH (DE)

( * ) Notice: Subject to any disclaimer, the term of this patent is extended or adjusted under 35 U.S.C. 154(b) by 0 days.

(21) Appl. No.: 14/602,213

(22) Filed: Jan. 21, 2015

(65) Prior Publication Data

US 2015/0211289 A1 Jul. 30, 2015

(30) Foreign Application Priority Data

Jan. 24, 2014 (EP) ..... 14152514

(51) Int. Cl.

| | |
|---|---|
| ***E06B 1/62*** | (2006.01) |
| ***E06B 1/00*** | (2006.01) |
| ***E06B 1/68*** | (2006.01) |
| ***E06B 1/60*** | (2006.01) |
| ***E04B 1/76*** | (2006.01) |
| ***E06B 7/23*** | (2006.01) |
| ***E06B 1/64*** | (2006.01) |
| ***E06B 1/36*** | (2006.01) |

(52) U.S. Cl.

CPC ..... *E06B 7/2314* (2013.01); *E06B 1/36* (2013.01); *E06B 1/62* (2013.01); *E06B 1/64* (2013.01); *E06B 2001/626* (2013.01)

(58) Field of Classification Search

CPC ..... E06B 1/62; E06B 2001/626; E06B 2001/628; E06B 1/003; E06B 1/6069; E04B 1/6812; E04B 1/7604

USPC ..... 52/204.5, 108, 213, 216, 217, 309.4, 52/309.7, 393, 797.1, 717.03

See application file for complete search history.

(56) References Cited

U.S. PATENT DOCUMENTS

| | | | | | |
|---|---|---|---|---|---|
| 2,305,413 | A | * | 12/1942 | Gelin | 49/404 |
| 2,859,493 | A | * | 11/1958 | Matschke | 52/202 |
| 3,652,380 | A | * | 3/1972 | Strack | E06B 3/62 428/356 |
| 3,707,815 | A | * | 1/1973 | Molyneux | 52/213 |
| 4,037,563 | A | * | 7/1977 | Pflueger | A01K 63/003 119/253 |

(Continued)

FOREIGN PATENT DOCUMENTS

| | | | |
|---|---|---|---|
| DE | 4123647 | A1 | 12/1992 |
| DE | 202005020164 | U1 | 3/2006 |

(Continued)

*Primary Examiner* — Brian Glessner
*Assistant Examiner* — Omar Hijaz
(74) *Attorney, Agent, or Firm* — Jansson Munger McKinley & Kirby Ltd.

(57) ABSTRACT

A sealing element for sealing joints and the intermediate space between an inner wall, an outer wall shell and a window frame includes (1) a first block-shaped sealing element section of a first flexible foam having a first indentation hardness and (2) a second web-shaped sealing element section which projects from an edge area of the first sealing element section, the second sealing element section including at least one sealing strip which is a second flexible foam having a second indentation hardness, the first indentation hardness being at least 1.5 times greater than the second indentation hardness.

15 Claims, 5 Drawing Sheets

(56) References Cited

U.S. PATENT DOCUMENTS

| | | | | | |
|---|---|---|---|---|---|
| 4,561,223 | A * | 12/1985 | Gold | E06B 3/28 | 49/478.1 |
| 5,992,113 | A * | 11/1999 | Carter et al. | 52/396.06 | |
| 7,526,897 | B2 * | 5/2009 | Collins | 52/212 | |
| 7,797,891 | B2 * | 9/2010 | Michaud | E06B 1/6069 | 49/504 |
| 8,011,145 | B1 * | 9/2011 | Collins | E04B 1/4178 | 52/204.53 |
| 8,178,643 | B2 * | 5/2012 | Edstrom | C08G 18/482 | 49/504 |
| 8,349,426 | B2 * | 1/2013 | Deiss | 428/40.1 | |
| 8,516,772 | B2 * | 8/2013 | Cai | 52/742.13 | |
| 2004/0211134 | A1 * | 10/2004 | Glover et al. | 52/204.5 | |
| 2008/0134595 | A1 * | 6/2008 | Collins | E06B 1/62 | 52/204.5 |
| 2011/0120038 | A1 * | 5/2011 | Wormann et al. | 52/309.4 | |
| 2011/0131916 | A1 * | 6/2011 | Chen | E04F 15/02 | 52/588.1 |

FOREIGN PATENT DOCUMENTS

| | | | | |
|---|---|---|---|---|
| DE | 102009013107 | A1 | 11/2009 | |
| EP | 1801309 | A2 | 6/2007 | |
| EP | 1811111 | A2 * | 7/2007 | E06B 1/64 |
| EP | 2354410 | A2 * | 8/2011 | |

* cited by examiner

SEALING ELEMENT FOR SEALING JOINTS IN THE AREA OF WINDOWS

FIELD OF THE INVENTION

The present invention relates to sealing elements for sealing joints in the area of windows.

BACKGROUND OF THE INVENTION

In the construction industry, not only the single-shell building method, in which the interior space is separated from the exterior space by a wall, but also the double-shell method is known. In the double-shell building method, an inner, load-bearing wall is built facing the interior space. An outer front wall shell, also called a cladding wall or a facing wythe, is arranged a certain distance away from the inner wall (backing shell), as a result of which an intermediate space, which serves as thermal insulation, is formed between the inner wall and the outer wall shell. This intermediate space usually has a width of approximately 40-150 mm. The intermediate space, furthermore, is usually unfilled, but it can be filled later with insulating materials such as mineral wool.

Windows are usually mounted in such a way that they project into the plane of the intermediate space or are positioned entirely in this area. When windows are installed or replaced, an empty intermediate space, into which no standard thermal insulation can be introduced, therefore usually remains between the inner wall and the front wall shell, and/or a connection problem arises at the window frames. Problems therefore occur with sealing, with the thermal insulation, and with the attachment process during the installation of windows.

It is an object of the present invention to provide a sealing element which is especially well adapted to sealing windows in walls built by the double-shell method.

BRIEF SUMMARY OF THE INVENTION

According to an aspect of the invention, the sealing element for sealing joints comprises a first, block-shaped sealing element section made of a first flexible foam with a first indentation hardness and a second, web-shaped sealing element section. The second sealing element section projects from an edge area of the first sealing element section and comprises at least one sealing strip made of a second flexible foam with a second indentation hardness. The first indentation hardness is at least 1.5 times greater than the second indentation hardness.

In this way, a sealing element is provided which is especially well adapted to sealing a joint between interior masonry, an outer wall shell, and a window frame and makes it possible to provide adequate insulation at this location.

In preferred embodiments, the first indentation hardness is two times, more preferably three times, more preferably five times, more preferably seven times, and more preferably ten times greater than the second indentation hardness.

In a preferred embodiment, the first flexible foam is of the closed-cell type. As a result, the intermediate space between the inner masonry and the outer wall shell is sealed off in a substantially air-tight manner.

In a preferred embodiment, the first indentation hardness is in the range of 15-100 N, preferably in the range of 17-75 N, and more preferably in the range of 20-50 N. This first indentation hardness, which is relatively high for a flexible foam, offers the advantage that the first sealing element section becomes clamped in the intermediate space during installation of the sealing element and thus makes it possible for the sealing element to be securely positioned and held in place without additional aids.

In another preferred embodiment, the second indentation hardness is in the range of 0.1-10 N, preferably in the range of 0.5-7 N, and more preferably in the range of 1-5 N. This second indentation hardness, which is relatively "low" in comparison to the first indentation hardness, offers in turn the advantage that the sealing strip is readily compressible, conforms to the masonry and to the window frame, and seals off the gap between the outer masonry and the newly installed window frame in a manner impermeable to driving rain.

In one embodiment, the at least one sealing strip preferably forms the entire second sealing element section. An embodiment is preferred, furthermore, in which the first sealing element section and the second sealing element section are joined two-dimensionally to each other in the area of a joining surface, and the second sealing element section projects beyond the first sealing element section in a direction parallel to the joining surface. This makes it possible to fabricate the sealing element from the two flexible foams in a simplified manner. In addition, an arrangement of this type is especially well adapted to the given sealing task.

In a preferred embodiment, the second sealing element section comprises at least a first part and a second part, wherein the second part is the sealing strip. The sealing strip is preferably formed as a jacket on or around the first part of the second sealing element section. It is also preferable for the first part of the second sealing element section to be formed integrally with the first sealing element section. As a result of these configurations, sufficient and effective sealing is guaranteed in at least one section of the web-shaped second sealing element section.

In another preferred embodiment, the first sealing element section comprises a tapered portion in an area facing away from the second sealing element section. This makes it easier to insert or to fit the first sealing element section into the intermediate space between the inner wall and the outer wall shell.

The sealing strip is preferably impregnated, as a result of which the insulation and expansion properties of the flexible foam can be effectively adjusted.

In another embodiment, the second sealing element section comprises an adhesive layer on at least the side facing the first sealing element section. This serves to improve the attachment of the web-shaped second sealing element section to the window frame.

The first sealing element section preferably consists of a foamable plastic based on polyethylene or polypropylene. It is also preferable for the sealing strip to be formed out of one of the materials polyurethane, polyethylene, polyvinyl chloride, or polypropylene. These materials are exceptionally well adapted to achieving the properties (insulation and indentation hardness) of the sealing element sections described above.

In another preferred embodiment, the ratio of the thickness of the first sealing element section to the thickness of the second sealing element section lies in the range of 2:1-30:1, preferably in the range of 2.5:1-15:1, and more preferably in the range of 3:1-10:1. This embodiment is especially well adapted to the corresponding installation situation and the previously described sealing task.

A building section comprises an inner wall and outer wall shell, wherein an intermediate space is formed between the inner wall and the outer wall shell. The outer wall shell extends beyond the intermediate space, as a result of which a projection of the outer wall shell is formed. A window frame is supported at least partially on the inner wall or is attached thereto by suitable retaining clamps. At least one sealing element as described above is used here, wherein at least the first sealing element section is inserted into the intermediate space, wherein at least the second sealing element section extends along the projection of the outer wall shell, and wherein the window frame rests against the second sealing element section in the area of the sealing strip. This installation situation offers good, long-lasting insulation and can be achieved easily with the sealing element according to the invention.

BRIEF DESCRIPTION OF THE DRAWINGS

Additional features and advantages of the present invention can be derived from the following description, which refers to the drawings.

DETAILED DESCRIPTION OF SPECIFIC EMBODIMENTS

Figure 1:
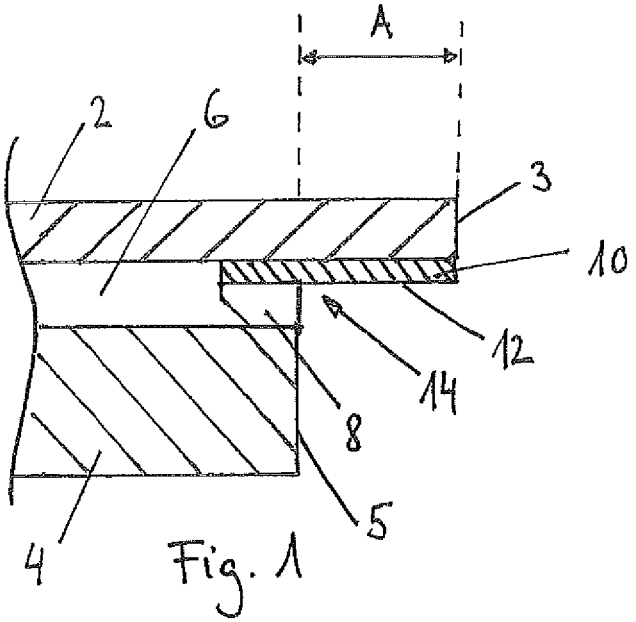
FIG. 1 is a schematic cross-sectional view of the installation situation of a sealing element according to the invention (without the window frame).

FIG. 1 shows a schematic cross-sectional view of the installation situation of a sealing element according to the invention. The outer wall shell 2 and the inner wall 4 are arranged a certain distance apart, so that an intermediate space 6 is present between them. The outer wall shell 2 projects further into the wall opening provided for the installation of a window frame than the inner wall 4 does. For the mounting of a window frame in the area of the plane of the intermediate space 6, the outer wall shell 2 thus forms a projection A between an end surface 3 of the outer wall shell 2 and an end surface 5 of the inner wall 4. The intermediate space 6 usually has a thickness of 15-150 mm, and preferably of 40-60 mm. The length of the projection A between the end surfaces 3 and 5 can vary in size from one window opening to another and from one building to another.

Before the window frame is installed, a sealing element 14 according to the invention is inserted into the intermediate space 6 to seal off this intermediate space 6. The sealing element 14 consists essentially of a first sealing element section 8 and a second sealing element section 10. A more detailed description of the configuration of the sealing element 14 and its components is provided further below with reference to FIGS. 3 and 4.

As can be seen in FIG. 1, the first sealing element section 8 is accommodated almost completely in the intermediate space 6, and the sealing element 14 is clamped by the internal pressure of the material in the intermediate space 6 and thus held in place. The second sealing element section 10 preferably lies two-dimensionally on the outer wall shell 2 and covers preferably the entire projection A of the outer wall shell 2. The second sealing element section 10 thus also serves to compensate for variations in width between the end surfaces 3 and 5 of the outer wall shell 2 and the inner wall 4. At the same time, the second sealing element section 10 provides a seal against driving rain. The first sealing element section 8 can be flush with the end surface 5 of the inner wall 4 and serves to create an air-tight seal for the intermediate space 6.

Figure 2:
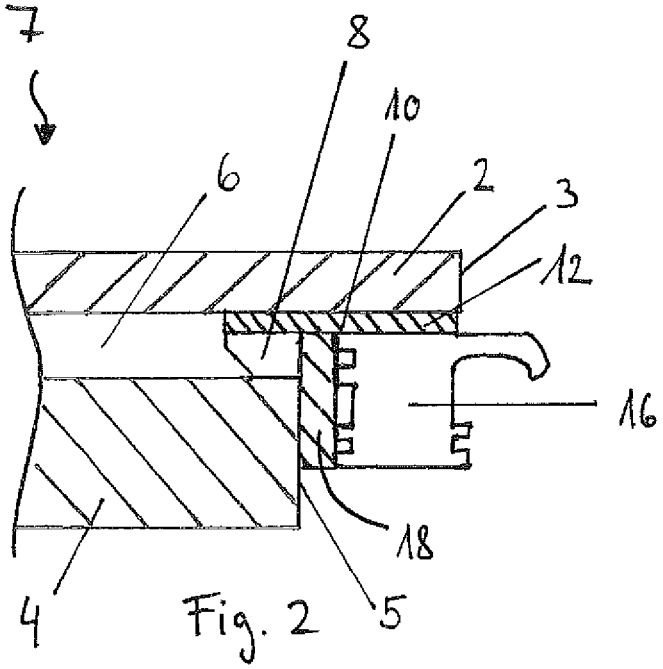
FIG. 2 is a schematic cross-sectional view of part of a building in the installation situation according to FIG. 1 with a window frame.
Figure 3:
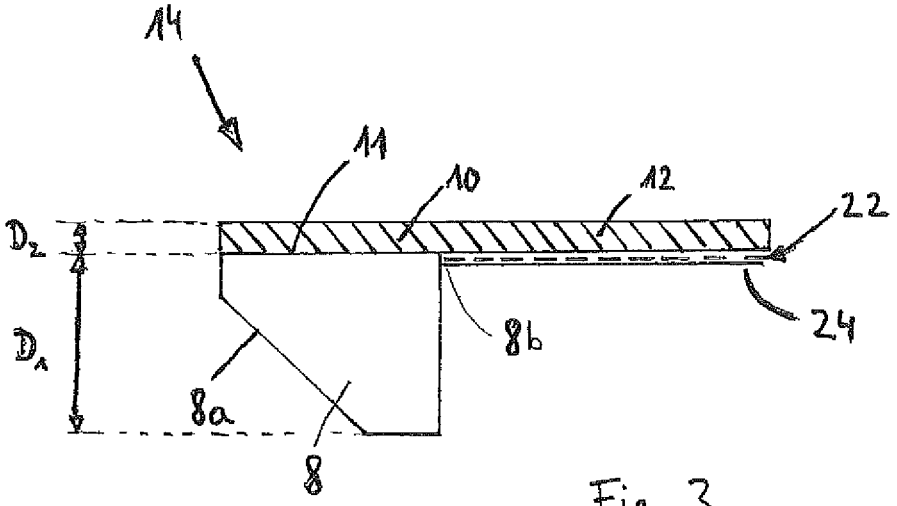
FIG. 3 is a schematic cross-sectional view of a first embodiment of the sealing element according to the invention.

FIG. 2 shows a building section 7, which, in addition to the components of FIG. 1, also comprises a window frame 16. An additional piece of insulating foam 18 positioned between the window frame 16 and the inner wall 4 is also shown. After the sealing element 14 according to the invention has been installed in the intermediate space 6, the additional insulating foam 18 can be attached to the inner surface formed by the end surface 5 and the first sealing element section 8. The window frame 16 is then positioned in the area of the projection A and aligned, wherein the second sealing element section 10 forms an insulating layer between the outer wall shell 2 and the window frame 16. As can be seen in FIG. 3, the sealing element 14 according to the invention can also comprise an adhesive layer 22, which is covered by a peel-off film 24. After the peel-off film 24 has been removed, the window frame 16 can be pushed against the second sealing element section 10. Then the window frame 16 is mechanically fastened to the load-bearing inner wall 4 by means of screws, for example. The insulating foam 18 can also be omitted or replaced by some other suitable insulating element.

The installation situation is illustrated schematically in FIGS. 1 and 2 on the basis of the left side of a window opening by way of example. It is apparent that the sealing element 14 according to the invention will usually be placed on all four sides around the entire window frame 16 and must be rotated appropriately to fit the other three sides of the window opening. The sealing element 14 is formed as a strip and extends typically over a length in the range of 50 cm to 2 m, but longer or shorter sealing elements 14 can also be produced. A single sealing element 14 can be arranged on each side of the window, or several sealing elements 14 can be arranged in a row, preferably butting against each other. The ends of the various sealing elements 14 can be joined to each other, preferably bonded with an adhesive.

In addition to the previously described parts, other insulating foams (flexible foams) or sealing tapes such as the additional insulating foam 18 shown in FIG. 2, for example, can be used in any of the variants known to the person skilled in the art to insulate the window frame 16. The arrangement of these various sealing means can be adapted to the conditions found in the individual case and to the configurations of the outer wall shell 2 and the inner wall 4.

FIG. 3 shows a schematic cross-sectional view of a first embodiment of the sealing element 14 according to the invention. The sealing element 14 comprises a first block-shaped sealing element section 8 and a second web-shaped sealing element section 10. The first or block-shaped sealing element section 8 is formed out of a first flexible foam with a first indentation hardness, whereas the second or web-shaped sealing element section 10 comprises a sealing strip 12 made of a second flexible foam with a second indentation hardness. In the present case of FIG. 3, the sealing strip 12 forms the entire second sealing element section 10.

The first indentation hardness is at least 1.5 times greater than the second indentation hardness. The first indentation hardness is preferably two times greater, more preferably three times greater, more preferably five times greater, more preferably seven times greater, and more preferably ten times greater than the second indentation hardness. This guarantees that the sealing element 14 is clamped securely in the intermediate space 6 after insertion, whereas the sealing strip 12, because of its compressibility and restoring force, can conform to the surfaces of the outer wall shell 2 and of the window frame 16. The indentation hardness is determined on the basis of DIN 53579:2009-01, as will be explained in detail at the end of this description.

The first indentation hardness is in the range of 15-100 N, preferably in the range of 17-75 N, and more preferably in the range of 20-50 N. The second indentation hardness is in the range of 0.1-10 N, preferably in the range of 0.5-7 N, and more preferably in the range of 2-5 N.

To achieve the desired indentation hardness and the desired insulating properties, the following materials can be considered in particular: for the first hard flexible foam, materials based on polyethylene or polypropylene; for the second soft flexible foam, materials based on polyurethane, polyethylene, polyvinyl chloride, or polypropylene.

The first flexible foam is preferably of the closed-cell or mixed-cell type, and the second flexible foam will usually be a mixed-cell or open-cell flexible foam, which is impregnated. Other materials which satisfy the requirements can also be used.

In the embodiment of the sealing element 14 shown in FIG. 3, the two sealing element sections 8 and 10 are joined to each other two-dimensionally in the area of the joining surface 11. The web-shaped second sealing element section 10 projects beyond the edge area 8*b* of the first sealing element section 8. The length of the part of the second sealing element section 10 projecting beyond the first sealing element section 8 can be adapted appropriately to the distance to the end surface 3 of the outer wall shell 2. The second sealing element section 10 is usually configured in such a way that its height (smaller side surface) is considerably smaller than its length (larger side surface). For example, the ratio between the length and the height of the second sealing element section 10 can be in the range of 30:1-2:1. The first sealing element section 8 is substantially in the form of a block. To simplify insertion, the first sealing element section 8 preferably has a tapered portion 8*a*, wherein the taper is formed on the side of the first sealing element section 8 which is inserted first when the sealing element 14 is pushed into the intermediate space 6. In association with the choice of an appropriate insertion angle, the tapering simplifies the insertion and positioning of the sealing element 14. In addition to the tapered configuration shown, other embodiments which simplify the insertion of the sealing element 14 into the intermediate space 6 are also conceivable.

The thickness D1 of the first sealing element section 8 is defined as the distance between its inside surface, which, in the installed state, is intended to rest against the inner wall 4, and the side surface of the second sealing element section 10 facing the first sealing element section 8 in the edge area 8*b*. The thickness D2 of the sealing element strip 12 is defined as the distance between the side surface of the sealing strip 12 facing the first sealing element section 8 and the surface of the opposing side, i.e., the side which faces away from the first sealing element section 8 and which is intended to rest against the outer wall shell 2 when in the installed state. The thicknesses D1 and D2 are each measured in the completely relaxed state of the flexible foam. The thicknesses D1 and D2 are in a ratio in the range of 2:1-30:1, preferably of 2.5:1-15:1, and more preferably of 3:1-10:1, to each other.

The two-dimensional joining of the two sealing element sections 8 and 10 is obtained by adhesive bonding or lamination, for example. The use of other joining techniques known to the person skilled in the art and suitable for foam materials is possible. It is apparent that all of the sizes and ratios stated here can be varied in correspondence with the configuration of the intermediate space 6 and of the projection A of the outer wall shell 2 beyond the inner wall 4.

Figure 4:
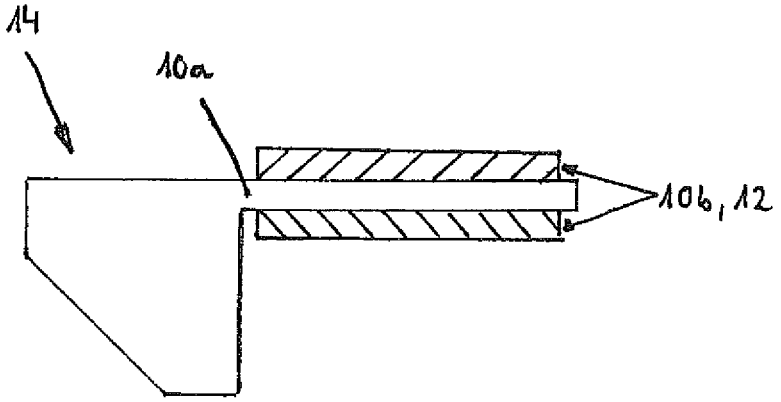
FIG. 4 is a schematic cross-sectional view of another embodiment of the sealing element according to the invention.

FIG. 4 shows another embodiment of the sealing element 14 according to the invention, wherein the second sealing element section 10 now comprises at least two parts. A first part 10*a* of the second sealing element section 10 is formed integrally with the first sealing element section 8. The sealing strip or strips 12 form one or more second parts 10*b* of the second sealing element section 10. In the embodiment shown here, two sealing strips 12 are present, wherein a first sealing strip 12 is attached to the side surface of the first part 10*a* facing away from the first sealing element section 8, and a second sealing strip 12 is attached to the side surface of the first part 10*a* of the second sealing element section 10 facing the first sealing element section 8. The various embodiments of the sealing strip 12 can be joined by adhesion or lamination to the first part 10*a* of the second sealing element section 10. In this embodiment, it is also possible for only one of the two sealing strips 12 to be present.

In the case of the sealing element 14 according to the invention, the second sealing element section 10 can comprise an adhesive layer 22 at least on the side facing the first sealing element section 8. This adhesive layer 22 is covered by a peel-off film 24, and, as described in relation to FIGS. 1 and 2, serves to hold the second sealing element section 10 on the window frame 16. The adhesive layer 22 can, for example, be in the form of double-sided adhesive tape. This also applies to all of the embodiments of the sealing element 14 described below.

FIGS. 5*a-d* shows various embodiments of the sealing strip 12 for the case of the two-part configuration of the second sealing element section 10. The sealing strip 12 is preferably formed as a jacket 26 around the forward area of the web-shaped first part 10*a* of the second sealing element section 10. For this purpose, the jacket 26 is preferably closed on three sides, whereas it comprises an opening on a fourth side to accept the first part 10*a* of the second sealing element section 10.

It is apparent that the jacket 26 can enclose the forward area of the first part 10*a* of the second sealing element section 10, as shown in the schematic cross-sectional views of FIGS. 5*a-d*, but it is also possible for the sealing strip 12 to be arranged only on the top and bottom of the web. In addition, the jacket 26 forming the sealing strip 12 can be configured as either a one-part or a multi-part element.

Figure 5A:
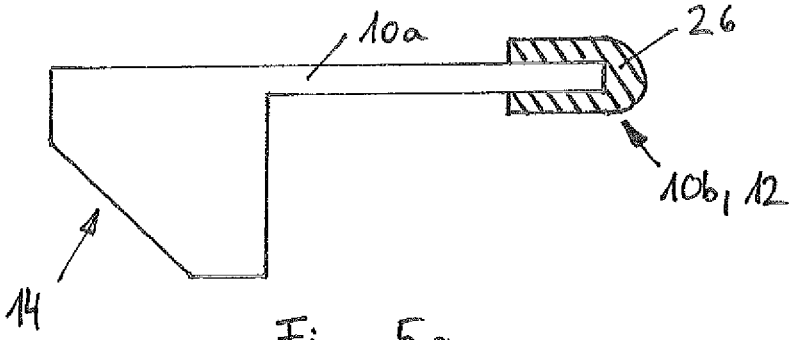
FIGS. 5*a-d* are schematic cross-sectional views of additional embodiments of the sealing element according to the invention with sealing strips of different shapes.

FIG. 5*a* shows a jacket 26 comprising an opening on one side, in which the first part 10*a* of the second sealing element section 10 is accommodated, wherein the entire inside surface of the jacket 26 rests on the first part 10*a* of the second sealing element section 10. The jacket 26 is rounded off at the outer section of the cap-like jacket 26 opposite the opening. Other embodiments in which the sealing strip 12 is angled or tapered at this end are also conceivable. In addition to attachment by means of an adhesive or by lamination, the jacket 26 can also be simply pushed onto the first part 10*a* of the second sealing element section 10 and held in position by the expansion pressure of the material. This also applies to the embodiments of FIGS. 5*b*-5*d*.

Figure 5B:
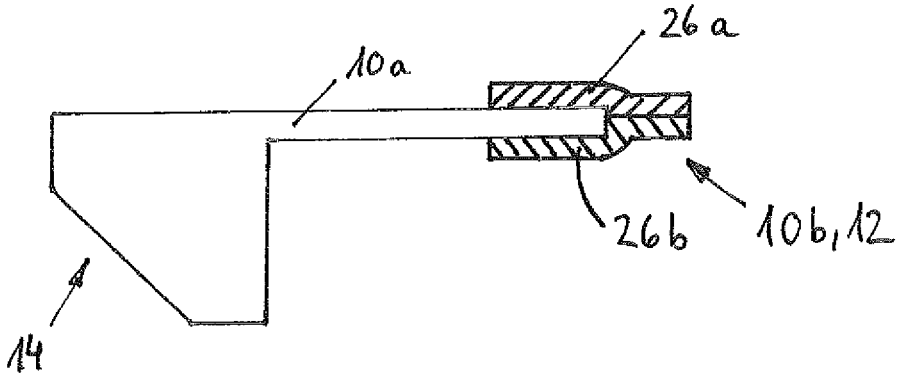

FIG. 5*b* shows a two-part jacket 26, which consists of a first part 26*a* and a second part 26*b*. The two parts 26*a,b* of the jacket 26 are joined to each other in the forward area opposite the opening, preferably by means of an adhesive. Here, too, other joining techniques suitable for use with foam are possible.

Figure 5C:
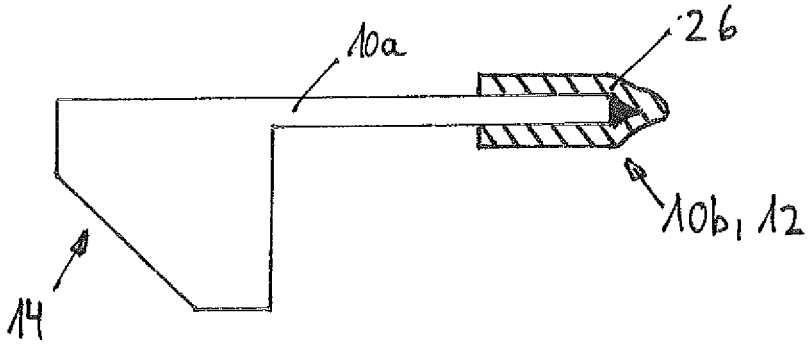

FIG. 5*c* shows a one-part jacket 26, only two inner surfaces of which rest against the first part 10*a* of the second sealing element section 10, a cavity thus being formed in the forward area of the web.

Figure 5D:
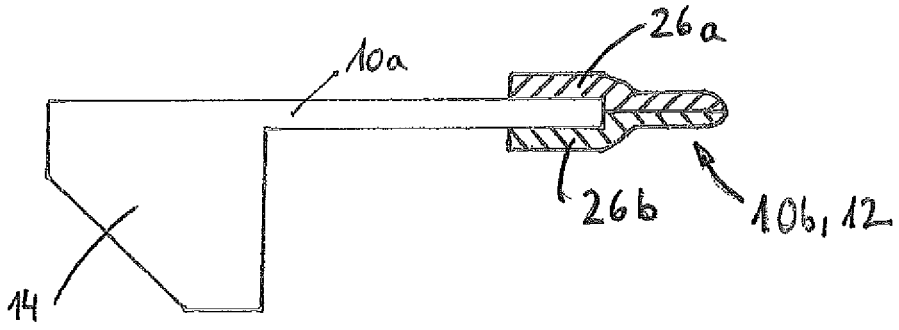

FIG. 5*d* shows again a two-part jacket 26 consisting of the parts 26*a* and 26*b*, which are bonded to each other by an adhesive, for example, in the forward area.

It is apparent that the embodiments of the sealing strip 12 are not limited to those illustrated in FIGS. 5*a*-*d*. On the contrary, additional embodiments which fulfill the sealing requirement and which can also be either of a one-part or of a multi-part type are also conceivable. In addition, the shape of the jacket 26, especially at the outer end opposite the opening, can be varied in any suitable way desired.

In addition to the previously described first and second sealing element sections 8 and 10, other embodiments of the sealing element 14 (FIGS. 6*a*, 6*b*) can also comprise a third sealing element section 30, which is configured as a web projecting from the first sealing element section 8 as an extension of one of its side surfaces, i.e., the surface which faces the second sealing element section 10 and is substantially perpendicular to it. The third sealing element section 30 is in turn preferably formed out of a flexible foam which returns to its original shape after compression, and which is made preferably of the same material as that of the sealing strip 12 or of a similar material.

Figure 6A:
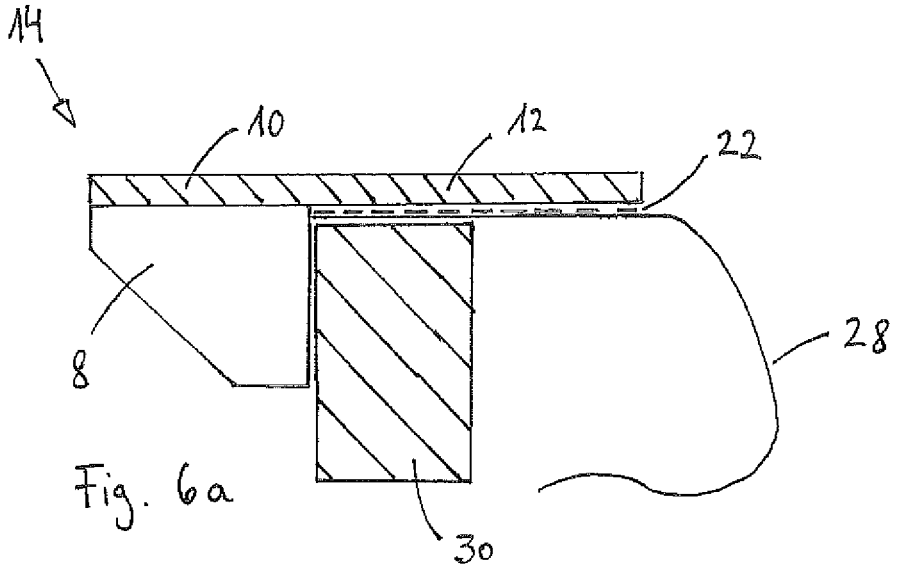
FIGS. 6*a*-6*b* are schematic cross-sectional views of the sealing element according to FIG. 3 with additional insulating foam and an additional plastic sheet.
Figure 6B:
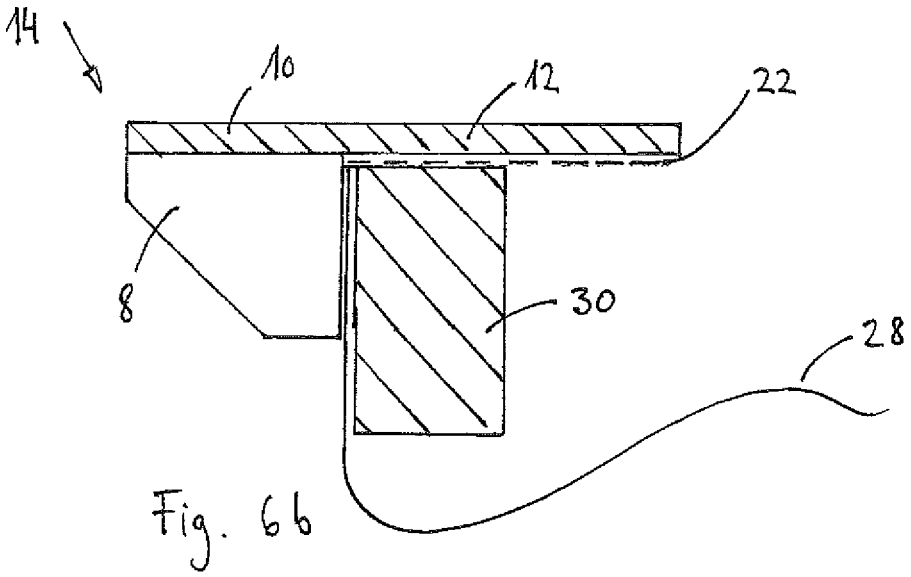

A plastic sheet 28 is also provided in FIGS. 6*a* and 6*b*. In place of the embodiment of the sealing element 14 of FIG. 3, it would also be possible here to use any of the other embodiments of the sealing element 14 according to the invention.

The additional plastic sheet 28 attached to the sealing element comprises additional insulation properties and ensures in particular especially good impermeability of the entire sealing arrangement to air and water vapor. Standard materials for this are, for example, polyethylene, polypropylene, polyamide, and copolymers. In an embodiment according to FIG. 6*a*, the plastic sheet 28 is attached along the web-shaped second sealing element section 10, i.e., between this second sealing element section 10 and the additional third sealing element section 30 of insulating foam. The plastic sheet 28 can be bonded by an adhesive, for example, to the second sealing element section 10. Other joining techniques are also conceivable.

In the embodiment according to FIG. 6*b*, the plastic sheet 28 is attached between the first sealing element section 8 and the additional third sealing element section 30 of insulating foam. Here, too, the plastic sheet 28 can be joined to the first sealing element section 8 in various ways. The plastic sheet 28, when in the installed state, is joined to the window frame 16 and thus forms a continuous air-tight and vapor-inhibiting layer between the masonry and the window profile.

The indentation hardness of foams is defined according to DIN 53579:2009-01 as the indentation force (in N) which an indentation plunger is required to exert to compress the foam by a defined distance. DIN 53579:2009-01 describes the test pieces to be used for the test, the equipment, and the procedure for conducting the test for determining the indentation hardness of foam materials.

The values for the indentation hardness given above are obtained by measurements according to the test procedure prescribed in DIN 53579:2009-01, wherein the test parameters described below are to be used. The exact test procedure and other previously specified parameters can be found in the standard.

A piece of foam measuring 45×45×10 mm (length×width×height) is to be used as the test piece. The number of test pieces is three per type of material. A frame of metal is used to surround the test piece. The frame has the corresponding inside dimensions of 45×45×10 mm (length×width×height) and the test piece is held in it with a press fit.

Other parameters of the test procedure adapted to the foam materials to be measured are defined in Section 6.2 of the DIN 53579:2009-01:

(a) indentation plunger according to Table 1, column V;

(b) defined initial force $F_0$=1 N (deviating from the DIN standard);

(c) feed rate during preload cycles: $v_C$=100 mm/min (deviating from Table 2 of the DIN standard);

(d) maximum indentation distance during the preload cycles: $ID_C$=7 mm (70% of the thickness of the material);

(e) reversal point of the indentation plunger: $L_R$=−3 mm;

(f) feed rate during the measurement cycle: $v_M$=50 mm/min (deviating from Table 2 of the DIN standard);

(g) maximum indentation distance during the measuring cycle: $ID_M$=7 mm (70% of the thickness of the material);

(h) indentation distance at which the results are to be determined during the measurement cycle: 4 mm (40% of the thickness of the material); and (i) no waiting time (0 seconds).

The invention claimed is:

1. A building construction section of a building comprising:

an inner wall of the building;

an outer wall shell of the building, the outer wall shell being spaced from the inner wall and forming an intermediate space therebetween, the outer wall shell extending beyond the intermediate space and projecting further into a wall opening provided for installation of building components than the inner wall to form a projection of the outer wall shell into said wall opening;

a window frame supported at least partially on the inner wall; and at least one sealing element comprising:

a first block-shaped sealing element section which is made of a first flexible foam having a first indentation hardness; and a second web-shaped sealing element section, the entire second sealing element section being formed by a sealing strip which is made of a second flexible foam having a second indentation hardness, the first and second sealing element sections thus being made of different foam materials, wherein the first indentation hardness is at least 1.5 times greater than the second indentation hardness, wherein the sealing element is inserted into the intermediate space in a position between the inner wall and the outer wall shell with the first sealing element section resting against the inner wall and the second sealing element section resting against the outer wall shell and extending at least along the projection of the outer wall shell and with the window frame resting against the second sealing element section in an area opposite to the outer wall shell, the second sealing element section being sandwiched between the outer wall shell and the first sealing element section within the intermediate space, and a portion of the second sealing element section projecting from the first sealing element section thus being sandwiched between the outer wall shell and the window frame, wherein the first and second sealing element sections are joined to each other two-dimensionally in an area of a joining surface, and the second sealing element section projects rectangularly from an edge area of the first sealing element section and beyond the first sealing element section in a direction parallel to the joining surface.

2. The building construction section of claim 1 wherein the first flexible foam is a closed-cell foam.

3. The building construction section of claim 1 wherein the first indentation hardness is within the range of 15-100 N as determined by DIN 53579:2009-01.

4. The building construction section of claim 1 wherein the first indentation hardness is within the range of 17-75 N as determined by DIN 53579:2009-01.

5. The building construction section of claim 1 wherein the first indentation hardness is within the range of 20-50 N as determined by DIN 53579:2009-01.

6. The building construction section of claim 1 wherein the second indentation hardness is within the range of 0.1-10 N as determined by DIN 53579:2009-1.

7. The building construction section of claim 1 wherein the second indentation hardness is within the range of 0.5-7 N as determined by DIN 53579:2009-1.

8. The building construction section of claim 1 wherein the second indentation hardness is within the range of 1-5 N as determined by DIN 53579:2009-1.

9. The building construction section of claim 1 wherein the first sealing element section includes a tapered surface on a side facing away from the second sealing element section.

10. The building construction section of claim 1 wherein the second sealing element section includes an adhesive layer at least on a side facing the first sealing element section.

11. The building construction section of claim 1 wherein the first sealing element section is formed of a material based on polyethylene or polypropylene.

12. The building construction section of claim 1 wherein the sealing strip is formed of a material based on polyurethane, polyethylene, polyvinyl chloride, or polypropylene.

13. The building construction section of claim 1 wherein the ratio of the thickness of the first sealing element section to the thickness of the second sealing element section is within the range of 2:1-30:1.

14. The building construction section of claim 1 wherein the ratio of the thickness of the first sealing element section to the thickness of the second sealing element section is within the range of 2.5:1-15:1.

15. The building construction section of claim 1 wherein the ratio of the thickness of the first sealing element section to the thickness of the second sealing element section is within the range of 3:1-10:1.

* * * * *